US008922322B2

(12) United States Patent
Lin et al.

(10) Patent No.: US 8,922,322 B2
(45) Date of Patent: Dec. 30, 2014

(54) COMBINED STRUCTURE OF HOLLOW BOBBIN AND CONDUCTIVE SHEET, HOLLOW BOBBIN, AND CONDUCTIVE SHEET

(71) Applicant: Delta Electronics, Inc., Taoyuan Hsien (TW)

(72) Inventors: Hua-Sheng Lin, Taoyuan Hsien (TW); Yi-Fan Wu, Taoyuan Hsien (TW); Yu-Chieh Li, Taoyuan Hsien (TW); Zhi-Liang Zhang, Taoyuan Hsien (TW); Ching-Hsien Teng, Taoyuan Hsien (TW); Yu-Liang Hung, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 39 days.

(21) Appl. No.: 13/845,120

(22) Filed: Mar. 18, 2013

(65) Prior Publication Data

US 2014/0062642 A1 Mar. 6, 2014

(30) Foreign Application Priority Data

Aug. 31, 2012 (TW) ..... 101131955 A
Feb. 7, 2013 (TW) ..... 102104752 U

(51) Int. Cl.

| | |
|---|---|
| ***H01F 27/30*** | (2006.01) |
| ***H01F 17/04*** | (2006.01) |
| ***H01F 27/28*** | (2006.01) |
| ***H01F 27/32*** | (2006.01) |

(52) U.S. Cl.

CPC ..... *H01F 27/2847* (2013.01); *H01F 27/325* (2013.01); *H01F 27/2866* (2013.01)

USPC ..... 336/208; 336/198; 336/221; 336/182

(58) Field of Classification Search

USPC ..... 336/198, 208, 196, 182, 183, 221, 232, 336/212

See application file for complete search history.

(56) References Cited

U.S. PATENT DOCUMENTS

| | | | | |
|---|---|---|---|---|
| 5,748,064 | A * | 5/1998 | Smeenge et al. | 336/83 |
| 7,567,164 | B2 * | 7/2009 | Chin | 336/198 |
| 2007/0057757 | A1 * | 3/2007 | Chen et al. | 336/212 |
| 2008/0180205 | A1 * | 7/2008 | Tsai et al. | 336/192 |
| 2008/0284551 | A1 * | 11/2008 | Chen et al. | 336/182 |

* cited by examiner

*Primary Examiner* — Mangtin Lian
(74) *Attorney, Agent, or Firm* — CKC & Partners Co., Ltd.

(57) ABSTRACT

A combined structure of hollow bobbin and conductive sheet for a transformer includes a hollow bobbin and at least one conductive sheet. The hollow bobbin includes an outer surface and at least one positioning structure formed on the outer surface. The conductive sheet is fit on the outer surface of the hollow bobbin and includes a main body and at least one engaging structure. The main body has a hollow portion, making the main body to have an inner circumference. The engaging structure is formed on the inner circumference of the main body and is engaged with the positioning structure of the hollow bobbin. The transformer includes at least one winding disposed on the outer surface of the hollow bobbin and abutting against the conductive sheet.

20 Claims, 12 Drawing Sheets

101

COMBINED STRUCTURE OF HOLLOW BOBBIN AND CONDUCTIVE SHEET, HOLLOW BOBBIN, AND CONDUCTIVE SHEET

RELATED APPLICATIONS

This application claims priority to Taiwan Application Serial Number 101131955, filed Aug. 31, 2012, and Taiwan Application Serial Number 102104752, filed. Feb. 7, 2013, which are herein incorporated by reference.

BACKGROUND

1. Technical Field

Embodiments of the present invention relate to a combined structure of hollow bobbin and conductive sheet. More particularly, embodiments of the present invention relate to a combined structure of hollow bobbin and conductive sheet that is easy to assemble.

2. Description of Related Art

There are a wide variety of electronic devices used in the world today. A transformer is indispensable in such devices for adjusting voltage to a level required by the devices.

A transformer typically includes a bobbin, cores, a primary coil and a secondary coil. The primary coil and the secondary coil are wound on the bobbin. When providing an input voltage to the primary coil, electromagnetic induction will occur in the cores, and an output voltage will be generated in the secondary coil. The output voltage and the input voltage can be varied by controlling the differences between the turns of the primary coil and the secondary coil, thereby achieving the effect of voltage transformation.

The transformer generally employs conductive sheets as the primary coil. Blades are disposed on the bobbin and a winding groove is formed between each pair of the blades. The secondary coil can be wound in the winding grooves, and the blades separate the primary coil and the secondary coil.

Therefore, the blades must be placed between the primary coil and the secondary coil in a typical transformer, and because the blades are thick, the space available for winding the coil is consequently reduced. Moreover, the typical transformer is not easy to be assembled.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one aspect of the present invention, a combined structure of hollow bobbin and conductive sheet for a transformer is provided. The combined structure includes a hollow bobbin and at least one conductive sheet. The hollow bobbin includes an outer surface and at least one positioning structure formed on the outer surface. The conductive sheet is fit on the outer surface of the hollow bobbin and includes a main body and at least one engaging structure. The main body has a hollow portion, making the main body to have an inner circumference. The engaging structure is formed on the inner circumference of the main body and is engaged with the positioning structure of the hollow bobbin. The transformer includes at least one winding disposed on the outer surface of the hollow bobbin and abutting against the conductive sheet.

In another aspect of the present invention, a hollow bobbin for a transformer is provided. The transformer has at least one conductive sheet and at least one winding. The conductive sheet includes a main body and at least one engaging structure. The main body has a hollow portion making the main body to have an inner circumference. The engaging structure is formed on the inner circumference of the main body. The hollow bobbin includes an outer surface and at least one positioning structure formed on the outer surface. The conductive sheet is fit on the outer surface of the hollow bobbin. The engaging structure of the conductive sheet is engaged with the positioning structure of the hollow bobbin. The winding is disposed on the outer surface of the hollow bobbin and abuts against the conductive sheet.

In yet another aspect of the present invention, a conductive sheet for a transformer is provided. The transformer has a hollow bobbin and at least one winding. The hollow bobbin includes an outer surface and at least one positioning structure formed on the outer surface. The conductive sheet includes a main body having a hollow portion and at least one engaging structure. The hollow portion makes the main body to have an inner circumference. The engaging structure is formed on the inner circumference of the main body. The conductive sheet is fit on the outer surface of the hollow bobbin. The engaging structure of the conductive sheet is engaged with the positioning structure of the hollow bobbin. The winding is disposed on the outer surface of the hollow bobbin and abuts against the conductive sheet.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
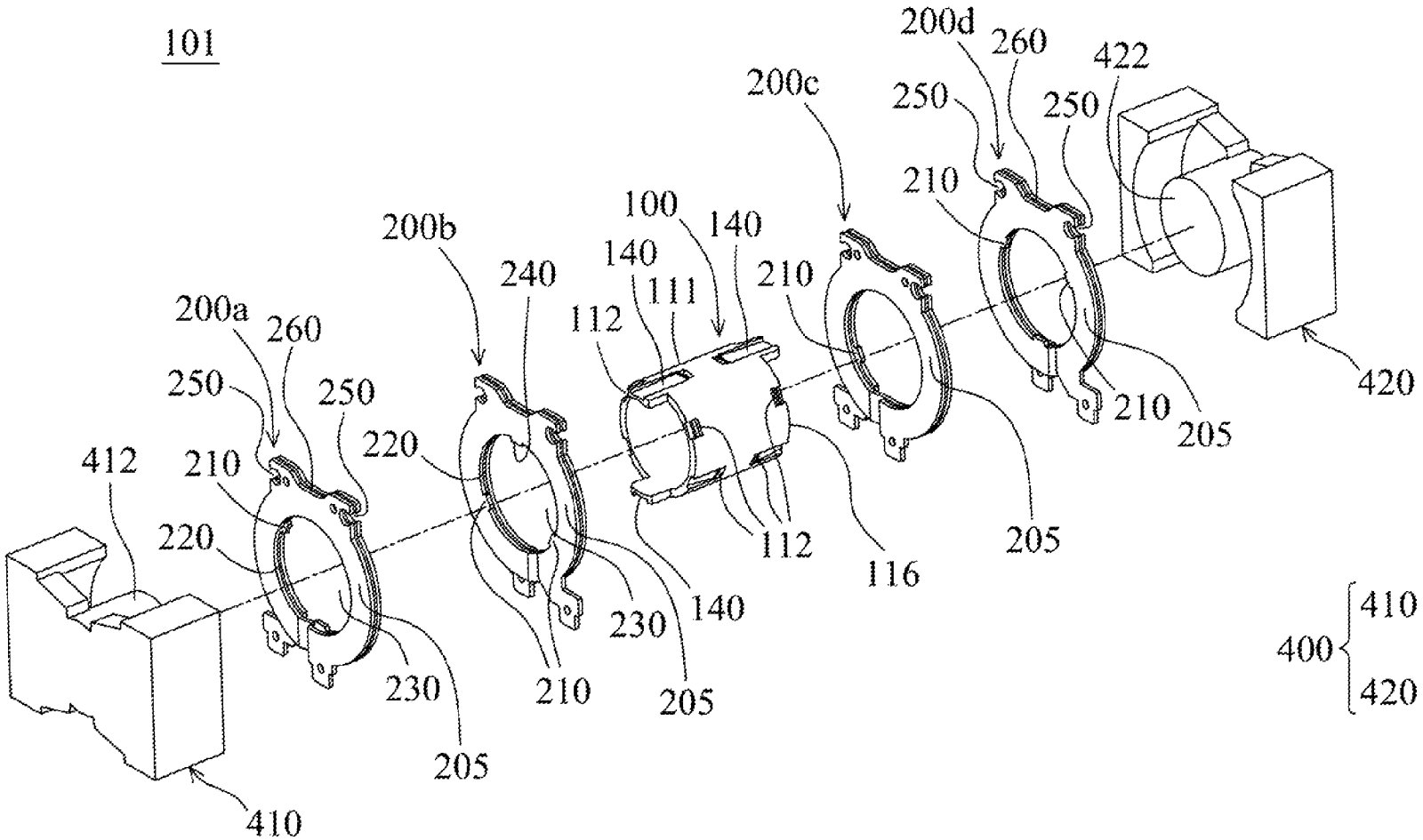
FIG. 1A is an exploded perspective view of a transformer in accordance with the first embodiment of the present invention.

Reference will now be made in detail to the present embodiments of the invention, examples of which are illustrated in the accompanying drawings. Wherever possible, the same reference numbers are used in the drawings and the description to refer to the same or like parts.

First Embodiment

Figure 1B:
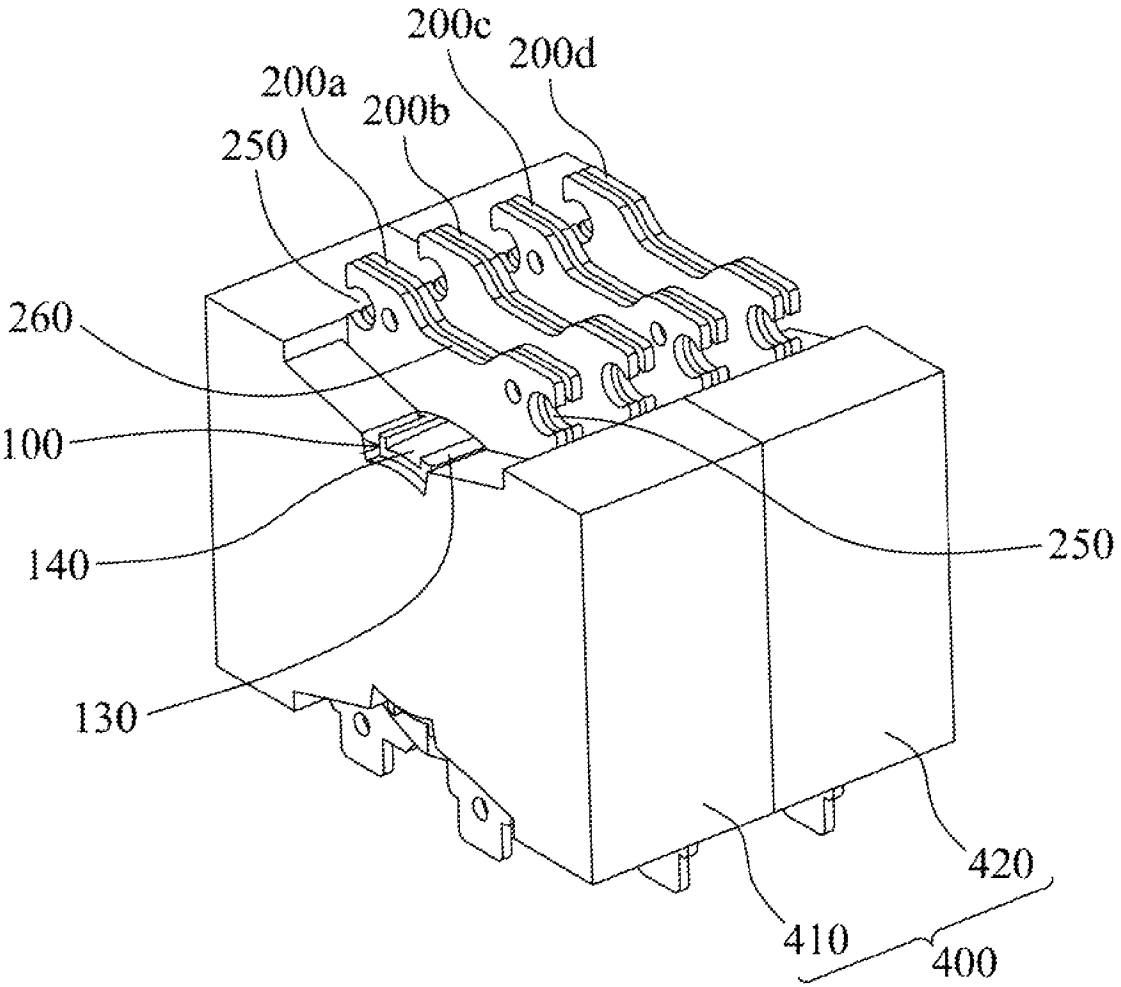
FIG. 1B is an assembled perspective view of the transformer in accordance with the first embodiment of the present invention.

Referring to FIGS. 1A and 1B, the combined structure of the hollow bobbin and the conductive sheet is adapted to a transformer 101, and it mainly includes a hollow bobbin 100 and a plurality of conductive sheets 200*a*~200*d*. The transformer 101 further includes at least one winding 300 (See FIG. 1E) and a core set 400.

Figure 1C:
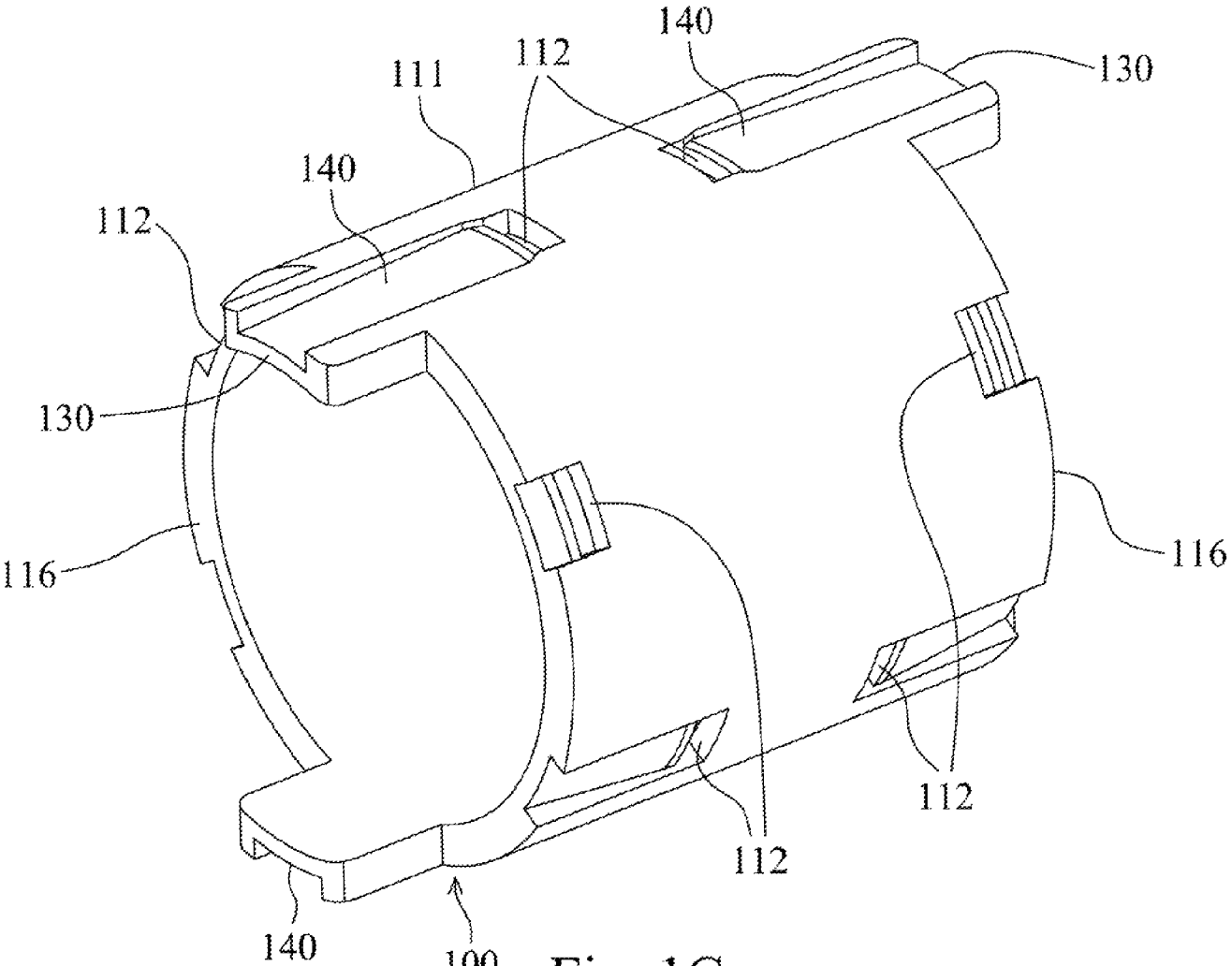
FIG. 1C is a perspective view of the hollow bobbin in FIG. 1A.
Figure 1D:
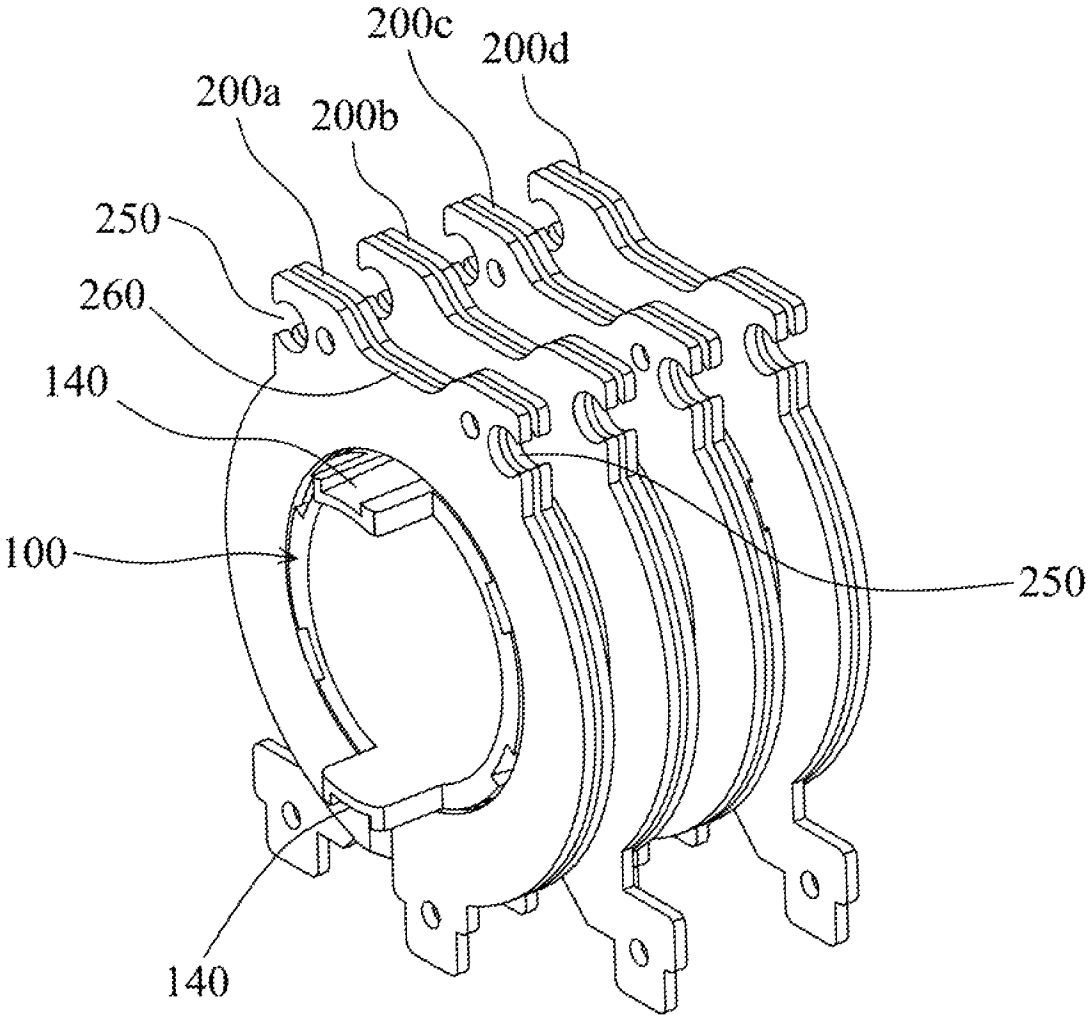
FIG. 1D is a perspective view of the combined structure of hollow bobbin and the conductive sheet in FIG. 1A.
Figure 1E:
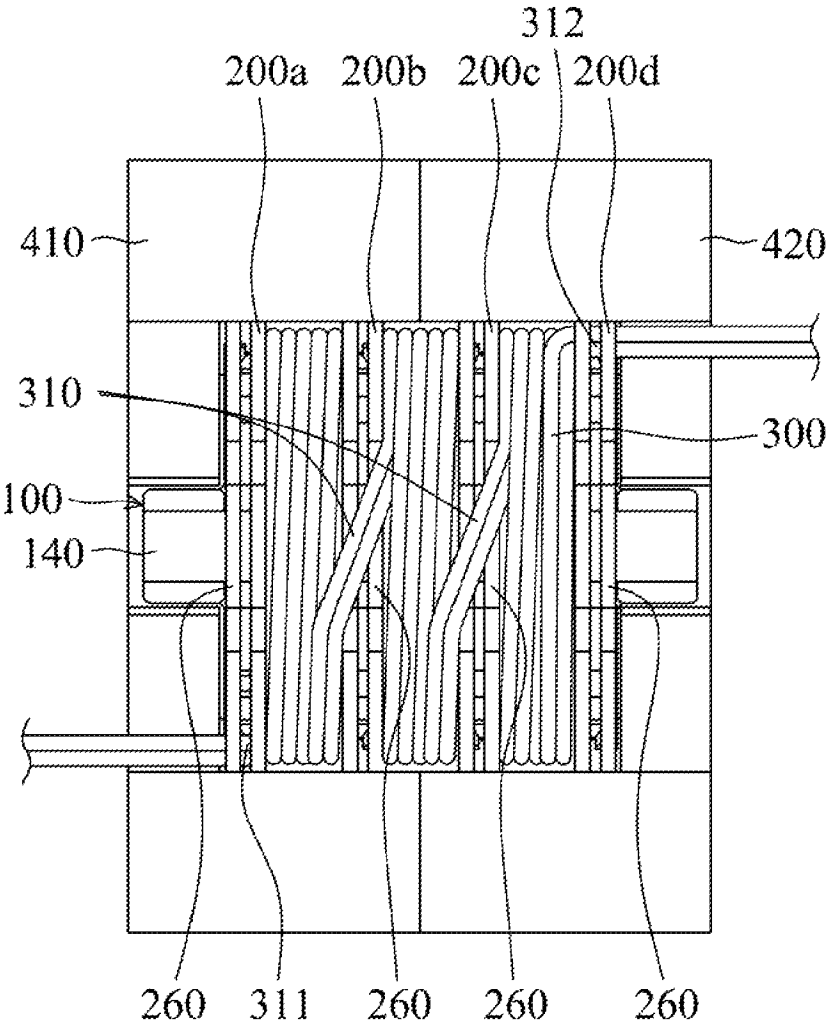
FIG. 1E is a top view in which a coil crosses the conductive sheet.

As shown in FIGS. 1A and 1C, the hollow bobbin 100 includes an outer surface 111 and a plurality of positioning structures 112 formed on the outer surface 111. In this embodiment, the hollow bobbin 100 can be formed by elastic material, so as to elastically deform. The positioning structure 112 is a positioning groove.

Referring to FIGS. 1A, 1B and 10, the conductive sheets 200*a*~200*d* are fit on the outer surface 111 of the hollow bobbin 100. As shown in FIG. 1A, the conductive sheets 200*a*~200*d* respectively include a main body 205, a plurality of engaging structures 210, two winding hanging part 250 and a winding crossing part 260. The main body 205 has a hollow portion 230 making the main body 205 to have an inner circumference 220. The engaging structure 210 is formed on the inner circumference 220 of the main body 205 and is engaged with the positioning structure 112 of the hollow bobbin 100. In this embodiment, the engaging structure 210 of each of the conductive sheets 200*a*~200*d* is a bump. When the conductive sheets 200*a*~200*d* are fit on the outer surface 111 of the hollow bobbin 100, the engaging structures 210 (the bumps) are respectively engaged with the positioning structures 112 (the positioning grooves) of the hollow bobbin 100.

In this embodiment, the shape and the size of the engaging structure 210 can be substantially the same as which of the positioning structure 112, so that the engaging structure 210 can be tightly engaged with the positioning structure 112, thereby preventing the conductive sheets 200*a*~200*d* from rotating on the hollow bobbin 100. For example, the engaging structure 210 can be, but is not limited to be, a protruded cone. The positioning structure 112 can be, but is not limited to be, a cone-shaped recess.

In this embodiment, the conductive sheets 200*a*~200*d* are not limited to include only two engaging structures 210. In other words, the conductive sheets 200*a*~200*d* may respectively include more than two engaging structures 210. More particularly, by increasing the amount of the engaging structures 210 and the positioning structures 112, the conductive sheets 200*a*~200*d* can be fit on the hollow bobbin 100 more stably.

The diameter of the hollow portion 230 of each of the conductive sheets 200*a*~200*d* is substantially equal to the outer diameter of the hollow bobbin 100, so as to enable the conductive sheets 200*a*~200*d* to be fit on the hollow bobbin 100.

In this embodiment, each of the conductive sheets 200*a*~200*d* is a double-layer structure formed by bending a single conductive piece. In other embodiments, each of the conductive sheets 200*a*~200*d* may be formed by assembling a plurality of single-layer conductive pieces. In this embodiment, each of the conductive sheets 200*a*~200*d* can be formed by, but is not limited to be formed by, copper.

The winding 300 (See FIG. 1E) is disposed on the outer surface 111 of the hollow bobbin 100, and it abuts against the conductive sheet 200*a*, the conductive sheet 200*b*, the conductive sheet 200*c* or the conductive sheet 200*d*. In this embodiment, the winding 300 is a coil. The space among the conductive sheet 200*a*, the conductive sheet 200*b*, the conductive sheet 200*c* and the conductive sheet 200*d* can be used as a winding groove, so that the winding 300 can be directly wound in the space among the conductive sheet 200*a*, the conductive sheet 200*b*, the conductive sheet 200*c* and the conductive sheet 200*d*. Therefore, the hollow bobbin 100 of the transformer 101 does not require additional blades to form the winding groove, thereby enlarging the winding space or reducing the size of the transformer 101.

Because the winding 300 is the coil (See FIG. 1E) in this embodiment, one end of the winding 300 (the coil) is hung on the winding hanging part 250, and a partial wire 310 of the winding 300 (the coil) crosses the winding crossing part 260. More particularly, in this embodiment, one wire end 311 can be hung on the wiring hanging part 250 of the conductive sheet 200*a* closest to the first core 410 of the core set 400 (See FIGS. 1A, 1B and 1E). Then, the rest of the winding 300 can be wound on the winding groove formed between the conductive sheet 200*a* and the conductive sheet 200*b*, and then be wounded on the winding groove formed between the conductive sheet 200*b* and the conductive sheet 200*c* after crossing the winding crossing part 260 of the conductive sheet 200*b*. Then, the rest of the winding 300 can be wounded on the winding groove formed between the conductive sheet 200*c* and the conductive sheet 200*d* after crossing the winding crossing part 260 of the conductive sheet 200*c*. Finally, another wire end 312 of the winding 300 can be hung on the winding hanging part 250 of the conductive sheet 200*d* closest to the second core 420 of the core set 400.

In this embodiment, the winding 300 can be the primary side of the transformer 101, and the conductive sheets 200*a*~200*d* can be the secondary side of the transformer 101, thereby achieving the effect of voltage transformation. In other embodiments, the winding can be a conductive sheet, such as the conductive sheet shown in this embodiment, and is not limited to be a coil.

As shown in FIGS. 1A and 1B, the core set 400 partially inserts into the hollow bobbin 100. More particularly, the core set 400 includes a first core 410 and a second core 420 opposite to the first core 410. Part of the first core 410 and part of the second core 420 respectively insert into opposite ends of the hollow bobbin 100.

More particularly, as shown in FIG. 1A, the first core 410 includes a first axis part 412, and the second core 420 includes a second axis part 422. The outer diameter of the first axis part 412 and the outer diameter of the second axis part 422 are substantially equal to the inner diameter of the hollow bobbin 100, so that the first axis part 412 and the second axis part 422 can tightly insert into the hollow bobbin 100. In this embodiment, the hollow bobbin 100 includes a plurality of position-limiting protrusions 130 (See FIGS. 1B and 1C). The position-limiting protrusions 130 are boards protruded outwardly from two ends 116 of the hollow bobbin 100. The shape of the position limiting protrusion 130 corresponds to the shape of part of the core set 400, so as to position the core set 400.

As shown in FIGS. 1A and 1C, in addition to the positioning structures 112, the hollow bobbin 100 further include a plurality of guiding channels 140. The guiding channels 140 are recessed on the outer surface 111 of the hollow bobbin 100 and connected to the positioning structures 112 and the end 116 of the hollow bobbin 100. The engaging structures 210 (the bumps) of the conductive sheets 200*a*~200*d* are engaged with the positioning structure 112 (the positioning groove) by sliding into the guiding channel 140.

During the assembling process of the transformer 101 the conductive sheets 200*a*~200*d* can be assembled on the hollow bobbin 100 by sliding onto the hollow bobbin 100. Therefore, the assembling process of the transformer 101 can be easy, thereby reducing the time required for assembling, so as to facilitate the mass production of the transformer 101.

Second Embodiment

Figure 2A:
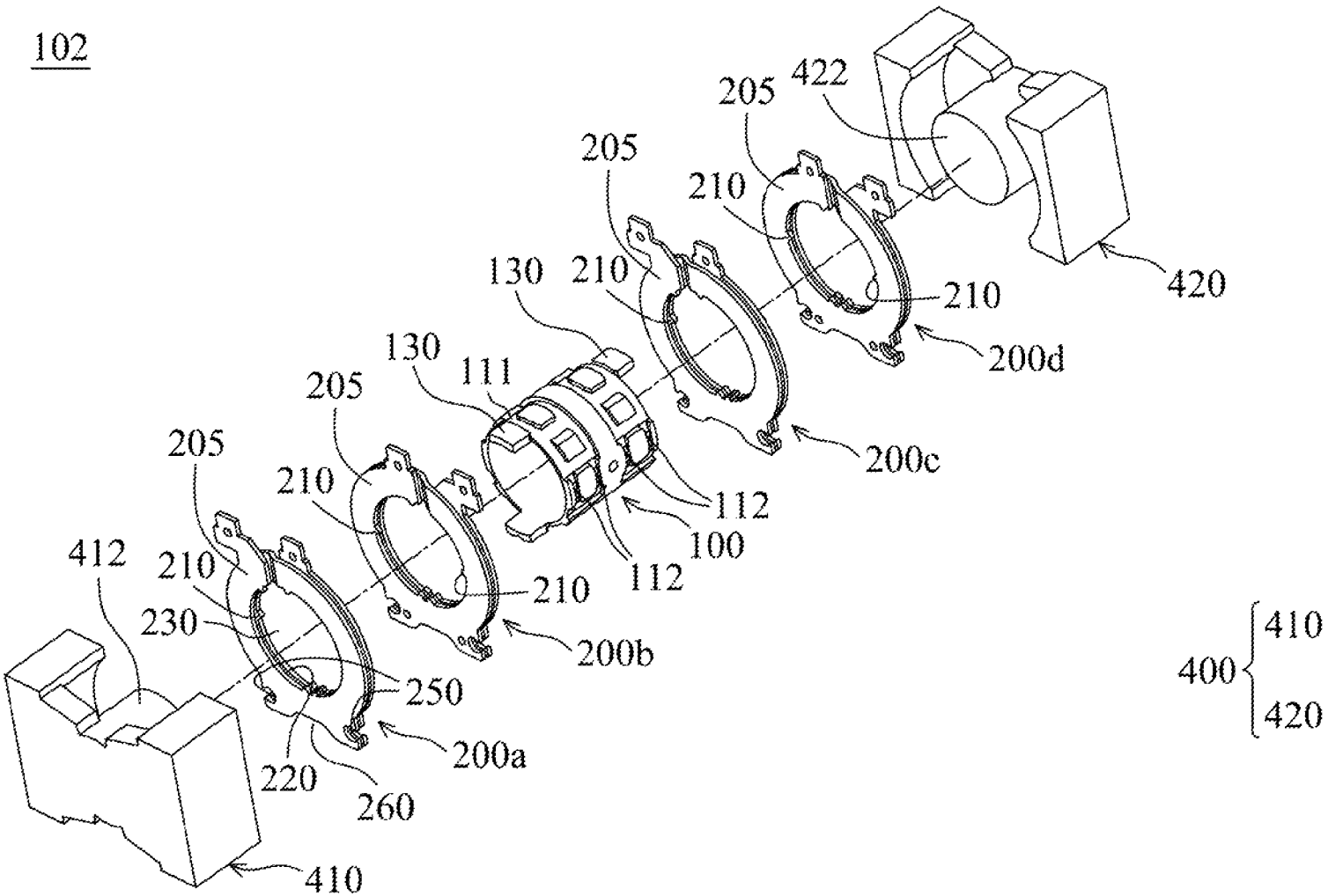
FIG. 2A is an exploded perspective view of a transformer in accordance with the second embodiment of the present invention.
Figure 2B:
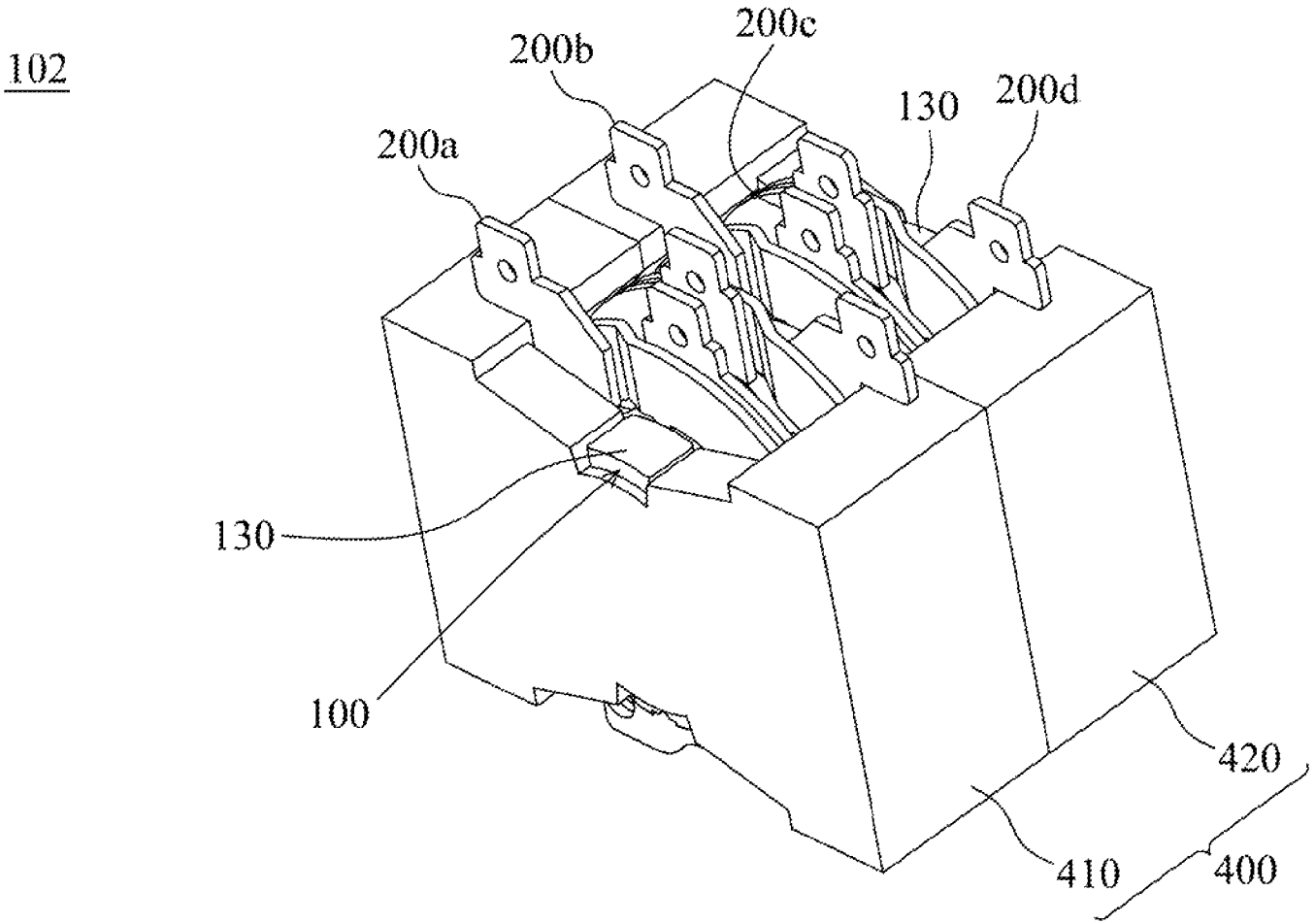
FIG. 2B is an assembled perspective view of the transformer in accordance with the second embodiment of the present invention.
Figure 2C:
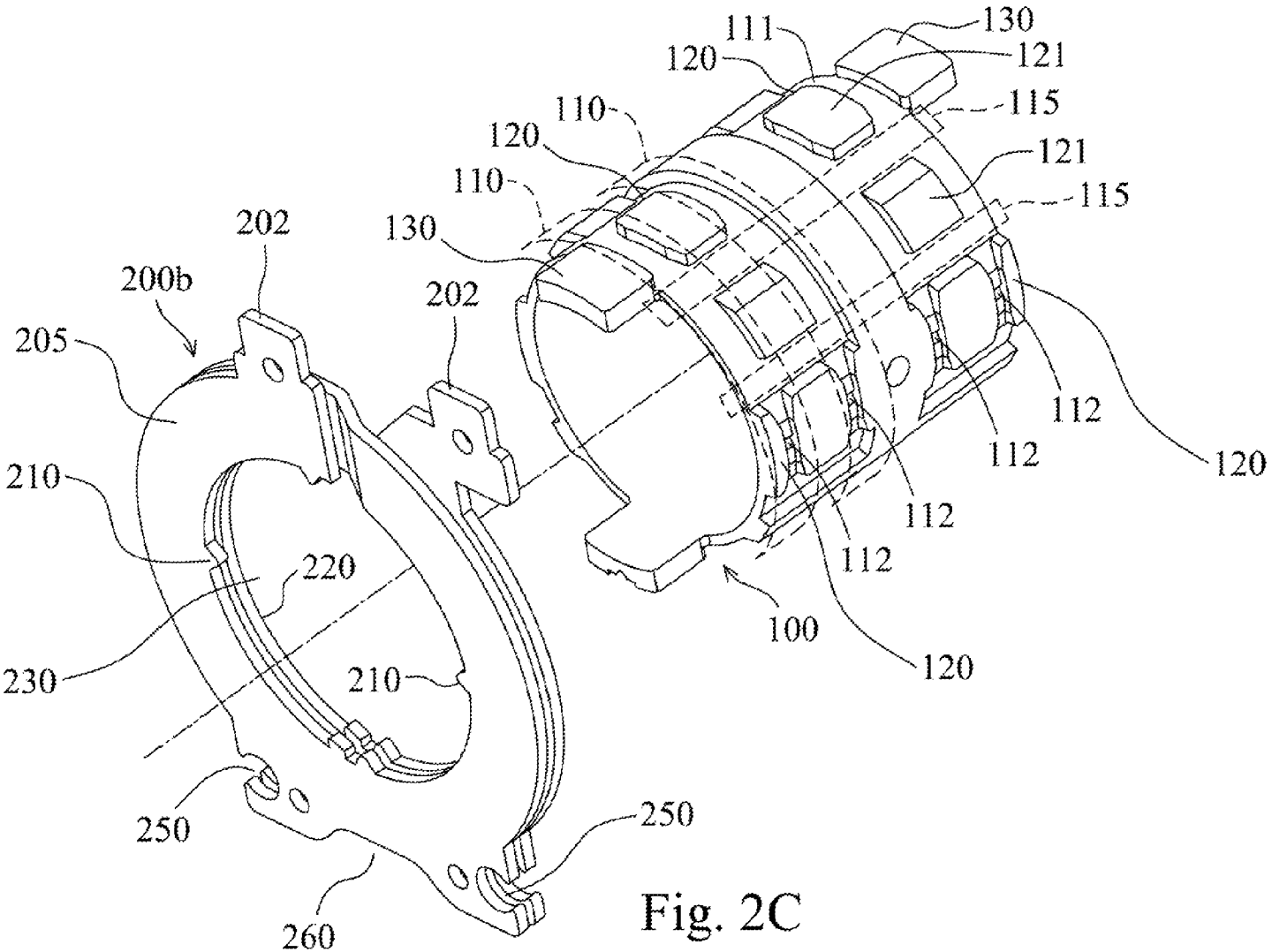
FIG. 2C is a perspective view of the hollow bobbin and the conductive sheet in FIG. 2A.

Referring to FIGS. 2A, 2B and 2C, the combined structure of the hollow bobbin and the conductive sheet is adapted to a transformer 102, and it mainly includes a hollow bobbin 100 and a plurality of conductive sheets 200*a*~200*d*. The transformer 102 further includes a plurality of windings (not shown) and a core set 400.

As shown in FIGS. 2A and 2C, the hollow bobbin 100 includes an outer surface 111 and a plurality of positioning structures 112 formed on the outer surface 111. In this embodiment, the hollow bobbin 100 can be formed by elastic material, so as to elastically deform. The positioning structure 112 is a positioning groove.

Referring to FIGS. 2A, 2B and 2C, the conductive sheets 200*a*~200*d* are fit on the outer surface 111 of the hollow bobbin 100. As shown in FIGS. 2A and 2C, the conductive sheets 200*a*~200*d* respectively include a main body 205, a plurality of engaging structures 210, two winding hanging part 250 and a winding crossing part 260. The main body 205 has a hollow portion 230 making the main body 205 to have an inner circumference 220. The engaging structure 210 is formed on the inner circumference 220 of the main body 205 and is engaged with the positioning structure 112 of the hollow bobbin 100. In this embodiment, the engaging structure 210 of each of the conductive sheets 200*a*~200*d* is a bump. When the conductive sheets 200*a*~200*d* are fit on the outer surface 111 of the hollow bobbin 100, the engaging structures 210 (the bumps) are respectively engaged with the positioning structures 112 (the positioning grooves) of the hollow bobbin 100.

During the process that the conductive sheets 200*a*~200*d* are assembled on the hollow bobbin 100, the conductive sheets 200*a*~200*d* are fit on the outer surface 111 of the hollow bobbin 100, and thereby slightly deform the hollow bobbin 100. Then, the conductive sheets 200*a*~200*d* can be rotated, so that the engaging structure 210 can be engaged with the positioning structure 112 of the hollow bobbin 100, thereby securing the conductive sheets 200*a*~200*d* on the hollow bobbin 100 and preventing free rotating of the conductive sheets 200*a*~200*d*.

In this embodiment, the shape and the size of the engaging structure 210 can be substantially the same as which of the positioning structure 112, so that the engaging structure 210 can be tightly engaged with the positioning structure 112, thereby preventing the conductive sheets 200*a*~200*d* from rotating on the hollow bobbin 100. For example, the engaging structure 210 can be, but is not limited to be, a protruded cone. The positioning structure 112 can be, but is not limited to be, a cone-shaped recess.

In this embodiment, the conductive sheets 200*a*~200*d* are not limited to include only two engaging structures 210. In other words, the conductive sheets 200*a*~200*d* may respectively include more than two engaging structures 210. More particularly, by increasing the amount of the engaging structures 210 and the positioning structures 112, the conductive sheets 200*a*~200*d* can be fit on the hollow bobbin 100 more stably.

The diameter of the hollow portion 230 of each of the conductive sheets 200*a*~200*d* is substantially equal to the outer diameter of the hollow bobbin 100, so as to enable the conductive sheets 200*a*~200*d* to be fit on the hollow bobbin 100.

In this embodiment, each of the conductive sheets 200*a*~200*d* is a double-layer structure formed by bending a single conductive piece. In other embodiments, each of the conductive sheets 200*a*~200*d* may be formed by assembling a plurality of single-layer conductive pieces. In this embodiment, each of the conductive sheets 200*a*~200*d* can be formed by, but is not limited to be formed by, copper. During the assembling process, at least one winding (not shown) can be disposed on the outer surface 111 of the hollow bobbin 100, and each winding abuts against the conductive sheet 200*a*, the conductive sheet 200*b*, the conductive sheet 200*c*, or the conductive sheet 200*d*.

When the winding is a coil, the space among the conductive sheet 200*a*, the conductive sheet 200*b*, the conductive sheet 200*c* and the conductive sheet 200*d* can be used as a winding groove, so that the winding can be directly wound in the space among the conductive sheet 200*a*, the conductive sheet 200*b*, the conductive sheet 200*c* and the conductive sheet 200*d*. Therefore, the hollow bobbin 100 of the transformer 102 does not require additional blades to form the winding groove, thereby enlarging the winding space or reducing the size of the transformer 102.

When the winding is the coil, one end of the winding is hung on the winding hanging part 250, and a partial wire of the winding crosses the winding crossing part 260. More particularly, in this embodiment, one wire end of the winding (the coil) can be hung on the wiring hanging part 250 of the conductive sheet 200*a* closest to the first core 410 of the core set 400 (See FIGS. 2A-2C). Then, the rest of the winding can be wound on the winding groove formed between the conductive sheet 200*a* and the conductive sheet 200*b*, and then be wounded on the winding groove formed between the conductive sheet 200*b* and the conductive sheet 200*c* after crossing the winding crossing part 260 of the conductive sheet 200*b*. Then, the rest of the winding can be wounded on the winding groove formed between the conductive sheet 200*c* and the conductive sheet 200*d* after crossing the winding crossing part 260 of the conductive sheet 200*c*. Finally, another wire end of the winding can be hung on the winding hanging part 250 of the conductive sheet 200*d* closest to the second core 420 of the core set 400.

In this embodiment, the winding can be the primary side of the transformer 102, and the conductive sheets 200*a*~200*d* can be the secondary side of the transformer 102, thereby achieving the effect of voltage transformation. In other embodiments, the winding can be a conductive sheet, and is not limited to be a coil.

As shown in FIGS. 2A and 2B, the core set 400 partially inserts into the hollow bobbin 100. More particularly, the core set 400 includes a first core 410 and a second core 420 opposite to the first core 410. Part of the first core 410 and part of the second core 420 respectively insert into opposite ends of the hollow bobbin 100.

More particularly, as shown in FIG. 2A, the first core 410 includes a first axis part 412, and the second core 420 includes a second axis part 422. The outer diameter of the first axis part 412 and the outer diameter of the second axis part 422 are substantially equal to the inner diameter of the hollow bobbin 100, so that the first axis part 412 and the second axis part 422 can tightly insert into the hollow bobbin 100. In this embodiment, the hollow bobbin 100 includes a plurality of position-limiting protrusions 130 (See FIGS. 2B and 2C). The position-limiting protrusions 130 are boards protruded outwardly from two ends of the hollow bobbin 100. The shape of the position limiting protrusion 130 corresponds to the shape of part of the core set 400, so as to position the core set 400.

As shown in FIG. 2C, at least two protrusion sets 120 are protruded on the outer surface 111 of the hollow bobbin 100. In this embodiment, four protrusion sets 120 are provided. The four protrusion sets 120 define a predetermined distance therebetween. The positioning structure 112 (the positioning groove) and the conductive sheets 200*a*~200*d* are disposed between the protrusion sets 120. The winding (not shown) is disposed on at least some of the protrusion sets 120. Each of the protrusion sets 120 comprises a plurality of protrusions 121, and the protrusions 121 are spaced apart from each other and surround the outer surface 111 of the hollow bobbin 100.

As shown in FIG. 2C, each of the protrusions 121 of each of the protrusion sets 120 and a central axis of the hollow bobbin 100 define a distance therebetween. The distances are substantially equal. The protrusions 121 of adjacent two of the protrusion sets 120 are parallel to each other and symmetrically disposed on the outer surface 111 of the hollow bobbin 100, so as to form a plurality of first passages 110 and a plurality of second passages 115 between the protrusions 121 of the protrusion sets 120 and the outer surface 111 of the hollow bobbin 100.

In this embodiment, the first passages 110 surround the outer surface 111 of the hollow bobbin 100 and are parallel to each other. The second passages 115 are perpendicular to the first passages 110. The positioning structure 112 (the positioning groove) is located on the first passage 110. The engaging structures 210 (the bump) of the conductive sheets 200*a*~200*d* move into the first passage 110 to engage with the positioning structure 112 (the positioning groove) after sliding into the second passage 115. In other embodiment, when the protrusions 121 of adjacent two of the protrusion sets 120 are disposed on the outer surface 111 of the hollow bobbin 100 in parallel, the protrusions 121 of adjacent two of the protrusion sets 120 can be arranged non-symmetrically.

In this embodiment, the positioning structure 112 (the positioning groove) is located between two adjacent protrusions 121 belonging to different protrusion sets 120. The engaging structures 210 (the bump) of the conductive sheets 200*a*~200*d* slide in the first passage 110 and is engaged with the positioning structures 112 (the positioning grooves) after moving from the second passage 115 to the first passage 110. The engaging structures 210 can be engaged with the positioning structure 112 by rotating in the first passage 110 as described in the foregoing paragraphs of this embodiment. In other embodiments, the positioning structure 112 can be located on the boundary between the first passage 110 and the second passage 115.

Third Embodiment

Figure 3A:
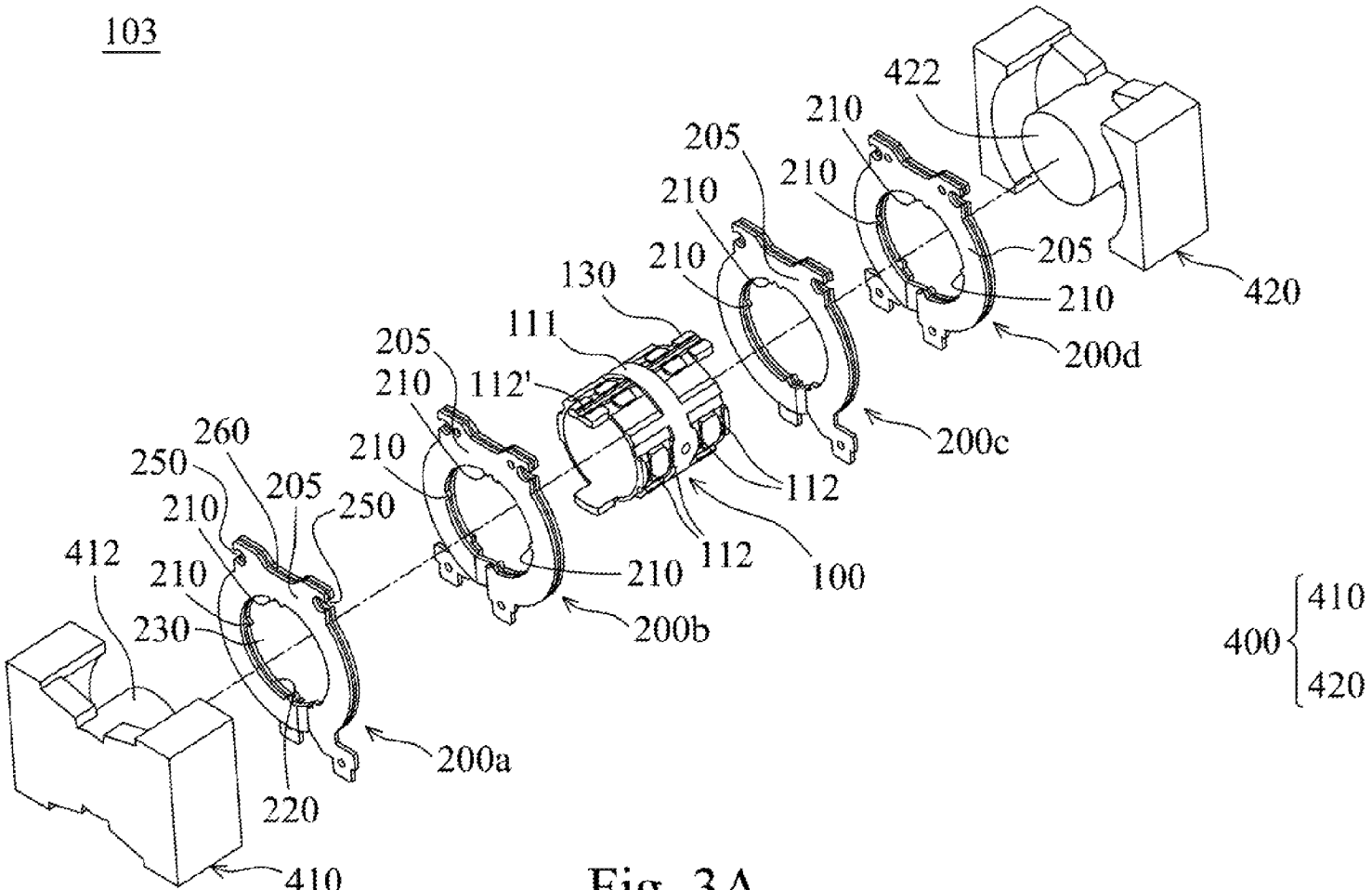
FIG. 3A is an exploded perspective view of a transformer in accordance with the third embodiment of the present invention.
Figure 3B:
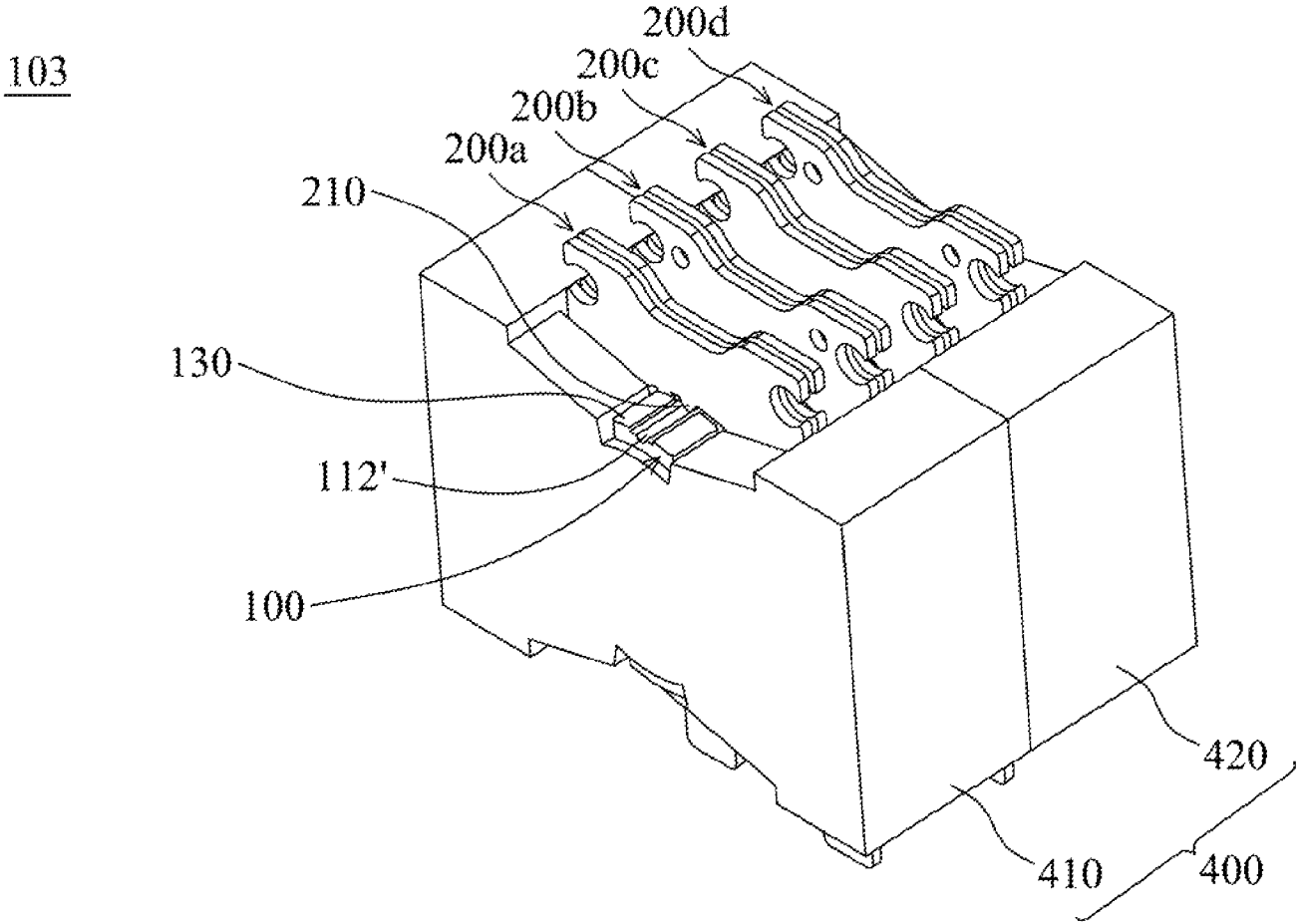
FIG. 3B is an assembled perspective view of the transformer in accordance with the third embodiment of the present invention.
Figure 3C:
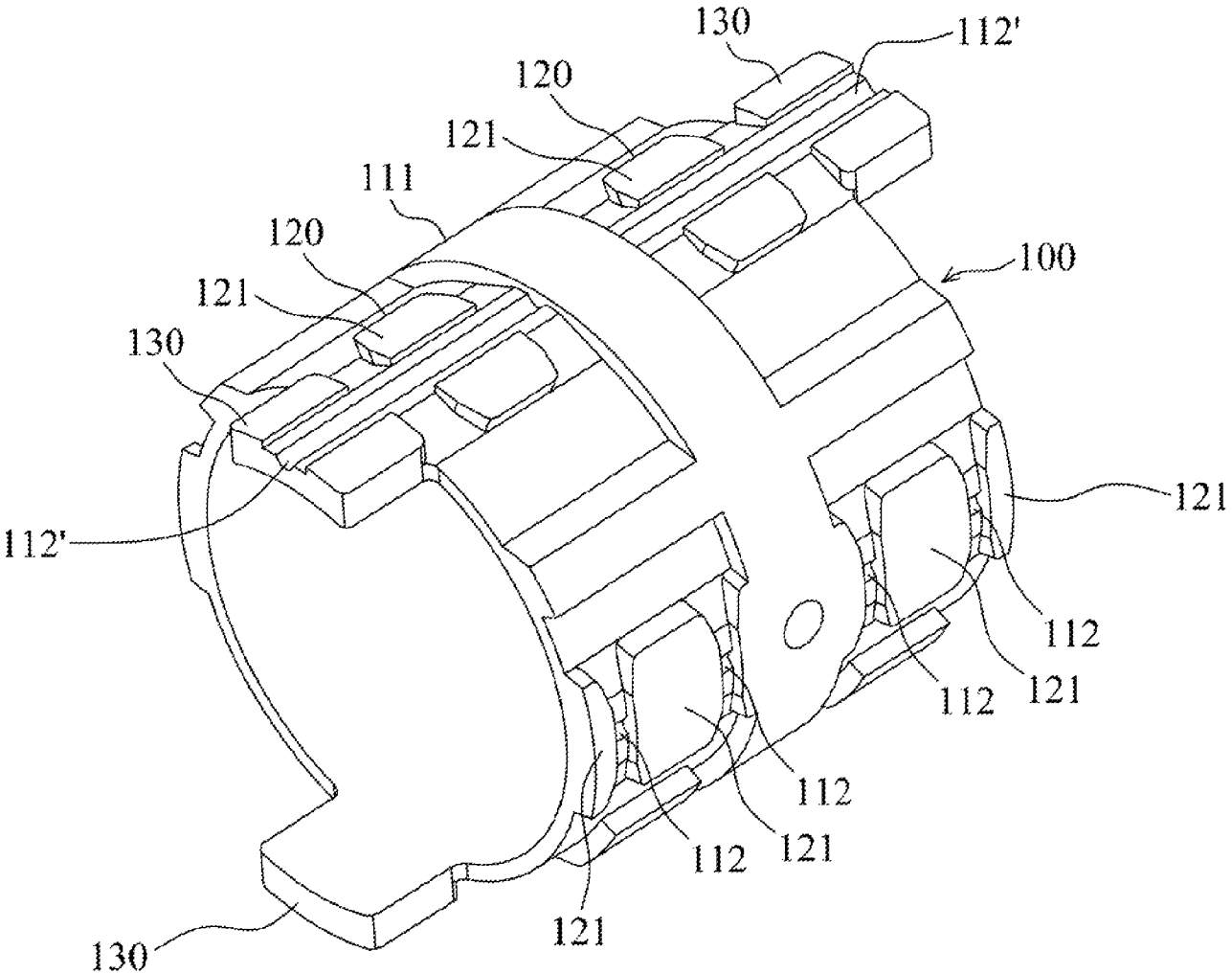
FIG. 3C is a perspective view of the hollow bobbin in FIG. 3A.

In this embodiment, the elements the same as which in the second embodiment are labeled same reference numbers. As shown in FIGS. 3A, 3B and 3C, the combined structure of the hollow bobbin and the conductive sheet is adapted to a transformer 103, and it mainly includes a hollow bobbin 100 and a plurality of conductive sheets 200*a*~200*d*. The transformer 103 further includes a plurality of windings (not shown) and a core set 400.

As shown in FIG. 3C, the difference between this embodiment and the second embodiment is the structure of the hollow bobbin 100. More particularly, part of the positioning structure 112' (the positioning groove) is a long and narrow groove that passes through the position-limiting protrusions 130 and the protrusions 121 adjacent to the position-limiting protrusions 130, so as to facilitate to manufacture the mold for the hollow bobbin 100.

Other elements, features or the assembling method thereof are the same as described in the second embodiment, and will not be repeatedly described herein.

During the assembling process of the transformer 103, the conductive sheets 200*a*~200*d* can be assembled on the hollow bobbin 100 by sliding onto the hollow bobbin 100. Therefore, the assembling process of the transformer 103 can be easy, thereby reducing the time required for assembling, so as to facilitate to manufacture the transformer 103.

Figure 4:
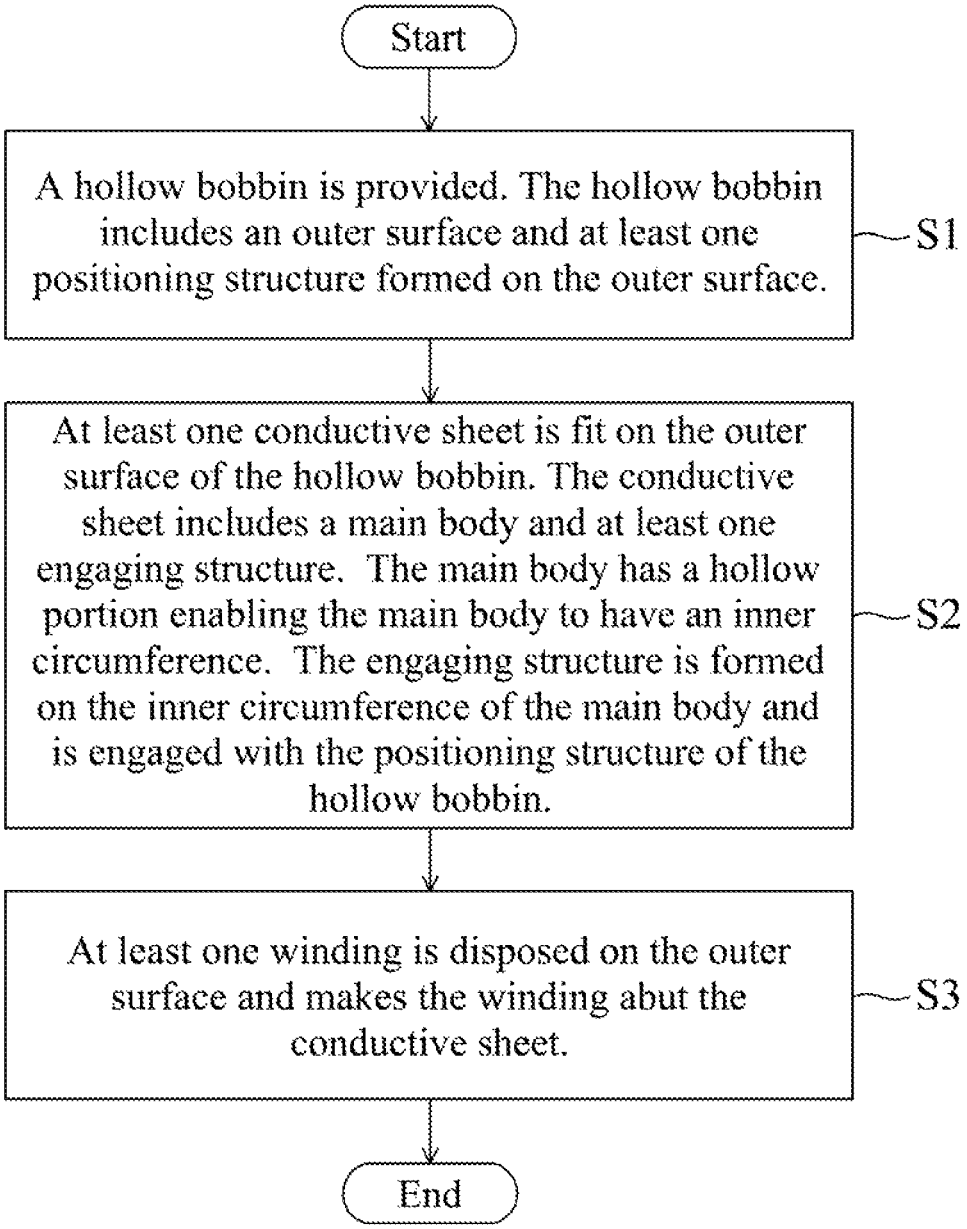
FIG. 4 is a flow chart illustrating the method of assembling the combined structure of the hollow bobbin and the conductive sheet.

In accordance with the foregoing embodiments, embodiments of the present invention provide a method for assembling the combined structure of the hollow bobbin and the conductive sheets. The method is shown as the steps S1~S4 in FIG. 4.

In step S1, a hollow bobbin is provided. The hollow bobbin includes an outer surface and at least one positioning structure formed on the outer surface.

In step S2, at least one conductive sheet is fit on the outer surface of the hollow bobbin. The conductive sheet includes a main body and at least one engaging structure. The main body has a hollow portion making the main body to have an inner circumference. The engaging structure is formed on the inner circumference of the main body and is engaged with the positioning structure of the hollow bobbin.

In step S3, at least one winding is disposed on the outer surface and abut the conductive sheet.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A combined structure of hollow bobbin and conductive sheet for a transformer, comprising:

a hollow bobbin having an outer surface and at least one positioning structure formed on the outer surface;

at least one conductive sheet fit on the outer surface of the hollow bobbin and comprising a main body and at least one engaging structure, wherein the main body has a hollow portion, wherein the hollow portion makes the main body to have an inner circumference, wherein the engaging structure is formed on the inner circumference of the main body and is engaged with the positioning structure of the hollow bobbin; and at least two protrusion sets protruded on the outer surface of the hollow bobbin, wherein each of the protrusion sets comprises a plurality of protrusions, and the protrusions are spaced apart from each other and surround the outer surface of the hollow bobbin, wherein the positioning structure is connected between adjacent two of the protrusions belonging to the protrusion sets different from each other, and the positioning structure is a positioning groove formed in a notched configuration extending inwardly from the outer surface;

wherein the transformer comprises at least one winding disposed on the outer surface of the hollow bobbin and abutting against the conductive sheet.

2. The combined structure of hollow bobbin and conductive sheet of claim 1, wherein the engaging structure of the conductive sheet is a bump, wherein the bump is engaged with the positioning groove.

3. The combined structure of hollow bobbin and conductive sheet of claim 2, wherein the hollow bobbin comprises a guiding channel recessed on the outer surface of the hollow bobbin and connected to the positioning structure and one end of the hollow bobbin, wherein the bump of the conductive sheet is engaged with the positioning groove by sliding into the guiding channel.

4. The combined structure of hollow bobbin and conductive sheet of claim 2, wherein the protrusion sets define a predetermined distance therebetween, and the conductive sheet disposed between the protrusion sets, wherein the winding is disposed on at least some of the protrusion sets.

5. The combined structure of hollow bobbin and conductive sheet of claim 4, wherein each of the protrusions of each of the protrusion sets and a central axis of the hollow bobbin define a distance therebetween, and the distances are substantially equal, and the protrusions of adjacent two of the protrusion sets are parallel to each other and symmetrically disposed on the outer surface of the hollow bobbin, so as to form a plurality of first passages and a plurality of second passages between the protrusions of the protrusion sets and the outer surface of the hollow bobbin, wherein the first passages surround the outer surface of the hollow bobbin and are parallel to each other, and the second passages are perpendicular to the first passages, wherein the positioning groove is located on the first passage, and the bump of the conductive sheet moves into the first passage to engage with the positioning groove after sliding into the second passage.

6. The combined structure of hollow bobbin and conductive sheet of claim 5, wherein the bump of the conductive sheet slides in the first passage and is engaged with the positioning groove after moving from the second passage to the first passage.

7. The combined structure of hollow bobbin and conductive sheet of claim 1, wherein the conductive sheet comprises a winding hanging part and a winding crossing part, and the winding is a coil, wherein one end of the winding is hung on the winding hanging part, and a partial wire of the winding crosses the winding crossing part.

8. The combined structure of hollow bobbin and conductive sheet of claim 1, wherein material of the hollow bobbin is elastic material.

9. The combined structure of hollow bobbin and conductive sheet of claim 1, further comprising a core set partially inserting into the hollow bobbin.

10. The combined structure of hollow bobbin and conductive sheet of claim 9, wherein the core set comprises a first core and a second core opposite to the first core, wherein part of the first core and part of the second core respectively insert into opposite ends of the hollow bobbin.

11. A hollow bobbin for a transformer, the transformer having at least one conductive sheet and at least one winding, the conductive sheet comprising a main body and at least one engaging structure, the main body having a hollow portion making the main body to have an inner circumference, the engaging structure being formed on the inner circumference of the main body, the hollow bobbin comprising:

an outer surface;

at least one positioning structure formed on the outer surface; and at least two protrusion sets protruded on the outer surface, wherein each of the protrusion sets comprises a plurality of protrusions, and the protrusions are spaced apart from each other and surround the outer surface, wherein the positioning structure is connected between adjacent two of the protrusions belonging to the protrusion sets different from each other, and the positioning structure is a positioning groove formed in a notched configuration extending inwardly from the outer surface;

wherein the conductive sheet is fit on the outer surface of the hollow bobbin, and the engaging structure of the conductive sheet is engaged with the positioning structure of the hollow bobbin, and the winding is disposed on the outer surface of the hollow bobbin and abuts against the conductive sheet.

12. The hollow bobbin of claim 11, wherein the engaging structure of the conductive sheet is a bump, wherein the bump is engaged with the positioning groove.

13. The hollow bobbin of claim 12, wherein the hollow bobbin comprises a guiding channel recessed on the outer surface of the hollow bobbin and connected to the positioning structure and one end of the hollow bobbin, wherein the bump of the conductive sheet is engaged with the positioning groove by sliding into the guiding channel.

14. The hollow bobbin of claim 12, wherein the protrusion sets define a predetermined distance therebetween, wherein the conductive sheet is disposed between the protrusion sets, wherein the winding is disposed on at least some of the protrusion sets.

15. The hollow bobbin of claim 14, wherein each of the protrusions of each of the protrusion sets and a central axis of the hollow bobbin define a distance therebetween, and the distances are substantially equal, and the protrusions of adjacent two of the protrusion sets are parallel to each other and symmetrically disposed on the outer surface of the hollow bobbin, so as to form a plurality of first passages and a plurality of second passages between the protrusions of the protrusion sets and the outer surface of the hollow bobbin, wherein the first passages surround the outer surface of the hollow bobbin and are parallel to each other, and the second passages are perpendicular to the first passages, wherein the positioning groove is located on the first passage, and the bump of the conductive sheet moves into the first passage to engage with the positioning groove after sliding into the second passage.

16. The hollow bobbin of claim 15, wherein the bump of the conductive sheet slides in the first passage and is engaged with the positioning groove after moving from the second passage to the first passage.

17. The hollow bobbin of claim 11, wherein material of the hollow bobbin is elastic material.

18. A conductive sheet for a transformer, the transformer having a hollow bobbin and at least one winding, the hollow bobbin comprising an outer surface, at least one positioning structure formed on the outer surface and at least two protrusion sets protruded on the outer surface, each of the protrusion sets comprising a plurality of protrusions spaced apart from each other and surround the outer surface, the positioning structure being connected between adjacent two of the protrusions belonging to the protrusion sets different from each other, the positioning structure is a positioning groove formed in a notched configuration extending inwardly from the outer surface, the conductive sheet comprising:

a main body having a hollow portion, wherein the hollow portion makes the main body to have an inner circumference; and at least one engaging structure formed on the inner circumference of the main body;

wherein the conductive sheet is fit on the outer surface of the hollow bobbin, wherein the engaging structure of the conductive sheet is engaged with the positioning structure of the hollow bobbin, wherein the winding is disposed on the outer surface of the hollow bobbin and abuts against the conductive sheet.

19. The conductive sheet of claim 18, wherein the engaging structure of the conductive sheet is a bump, and the bump is engaged with the positioning groove.

20. The conductive sheet of claim 18, further comprising a winding hanging part and a winding crossing part, and the winding is a coil, wherein one end of the winding is hung on the winding hanging part, and a partial wire of the winding crosses the winding crossing part.

* * * * *